US008056471B2

(12) United States Patent
Wakabayashi

(10) Patent No.: US 8,056,471 B2
(45) Date of Patent: Nov. 15, 2011

(54) PLASTIC, RE-SEALABLE ELONGATED CHECK VALVE APPLICATION TO A SQUARE, CYLINDRICAL OR FLAT TYPE OF A VACUUM FOOD PACKAGE

(76) Inventor: Akio Wakabayashi, Murrieta, CA (US)

( * ) Notice: Subject to any disclaimer, the term of this patent is extended or adjusted under 35 U.S.C. 154(b) by 0 days.

(21) Appl. No.: 12/880,253

(22) Filed: Sep. 13, 2010

(65) Prior Publication Data

US 2011/0003042 A1 Jan. 6, 2011

Related U.S. Application Data

(63) Continuation-in-part of application No. 12/079,847, filed on Mar. 27, 2008.

(51) Int. Cl.

| | |
|---|---|
| ***B65D 81/20*** | (2006.01) |
| ***B65D 33/01*** | (2006.01) |
| ***B65B 31/00*** | (2006.01) |
| ***B65B 55/00*** | (2006.01) |
| ***B65B 31/04*** | (2006.01) |
| ***B67C 3/00*** | (2006.01) |

(52) U.S. Cl. ..... 99/472; 53/510; 53/512; 383/100; 141/8; 141/65

(58) Field of Classification Search ..... 99/472, 99/473, 454; 53/434, 512, 510, 432; 383/63, 383/103, 210.1, 100; 137/852, 246; 141/325, 141/8, 65, 68; 206/524.8; 428/118; 229/117.29
See application file for complete search history.

(56) References Cited

U.S. PATENT DOCUMENTS

| | | | | |
|---|---|---|---|---|
| 2,638,263 | A * | 5/1953 | Jesnig | 383/103 |
| 3,086,869 | A * | 4/1963 | Seiferth et al. | 426/129 |
| 3,319,791 | A * | 5/1967 | Horne | 210/234 |
| 4,018,253 | A * | 4/1977 | Kaufman | 141/65 |
| 4,337,804 | A * | 7/1982 | Maruscak | 141/65 |
| 4,581,764 | A * | 4/1986 | Plock et al. | 383/101 |
| 4,941,310 | A | 7/1990 | Kristen | |
| 5,009,828 | A | 4/1991 | McCree | |
| 5,070,584 | A | 12/1991 | Dais et al. | |
| 5,494,165 | A * | 2/1996 | Detrick | 206/524.8 |
| 5,544,752 | A * | 8/1996 | Cox | 206/524.8 |
| 5,873,217 | A * | 2/1999 | Smith | 53/434 |
| 6,692,147 | B2 | 2/2004 | Nelson | |
| 7,316,101 | B1 * | 1/2008 | Nguyen et al. | 53/408 |
| 2003/0152296 | A1 | 8/2003 | Huffer | |
| 2003/0230201 | A1 * | 12/2003 | Zhao | 99/467 |
| 2004/0114837 | A1 | 6/2004 | Koyanagi | |
| 2004/0161178 | A1 | 8/2004 | Olechowski | |

(Continued)

*Primary Examiner* — Tu B Hoang
*Assistant Examiner* — Hemant Mathew
(74) *Attorney, Agent, or Firm* — Kirk A. Buhler; Buhler & Associates

(57) ABSTRACT

A flexible, plastic thin film food package is provided having an elongate opening check valve with an air removal port that allows repeated opening and resealing of the package followed by removal of air and moisture by vacuuming. The top open edge of the food package is bonded to a flexible but rigid frame that fits a lid with the air removal port flat valve. The flat valve is a compressed foam sponge and a thin film housed in a rigid case that is bonded to the lid. Air is removed with a spatula attachment of the vacuum pump that is inserted into the space between the lid and the flat check valve. Once vacuum is induced in the interior of the food package, the film covering the frame is sucked against the lid thereby shutting off influx of air into the package.

7 Claims, 7 Drawing Sheets

U.S. PATENT DOCUMENTS

2005/0172577 A1* 8/2005 Oltrogge ..... 53/434
2005/0196077 A1 9/2005 Ootsubo et al.
2005/0244083 A1 11/2005 McMahon
2007/0110340 A1* 5/2007 Buchman ..... 383/5
2007/0292055 A1* 12/2007 Reuhs et al. ..... 383/103

* cited by examiner

PLASTIC, RE-SEALABLE ELONGATED CHECK VALVE APPLICATION TO A SQUARE, CYLINDRICAL OR FLAT TYPE OF A VACUUM FOOD PACKAGE

CROSS REFERENCE TO RELATED APPLICATION

This application is a continuation-in-part of applicant's co-pending application Ser. No. 12/079,847 filed Mar. 27, 2008 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to a new and improved collapsible film food package suitable for vacuum storage of frozen fresh or cooked foods at low temperature and for an extended period of time. The food package of this invention allows repeated opening and closing to facilitate the addition and/or removal of food without significant loss of flavor or edibility.

2. Description of Related Art Including Information Disclosed Under 37 CFR 1.97 and 1.98

The food packaging industry includes vacuum or non-vacuum sealed food products, many of which packages are intended for use in storage at extremely low temperatures over long periods of time. Products include raw meat, poultry, fish, and other sea foods such as crustaceans, fresh vegetables, fully cooked foods such as pizza, and frozen confections such as ice cream.

Current re-sealable vacuum packages utilizing zipper strips and a flat disk check valve for removal of air from the interior of the containers. These packages are limited to a flat configuration, namely bags. Testing has indicated that these seals provided by the zipper strips fail to maintain vacuum over-night in about 20-30% of the time. A flat disk check valve is used in the current re-sealable vacuum food packages on the market. Testing has further found that sometimes it is difficult to aspirate air by a vacuum pump even when the food package is placed on a hard flat table surface.

The problem with presently designed factory sealed food packages is two-fold, the first being that ice is formed on the food content if the package is sealed without vacuum and the second being that no measures are provided to reseal the package for restoring the vacuum following opening of the sealed package for addition of food or for removing a portion of its content. In both cases, when the seal is broken to allow removal and/or addition of food, the entry of air and moisture into the package frequently causes ice formation. The result is a deterioration of the food and a reduction in flavor and edibility. Also the long term storage viability of the food contained therein is reduced upon resealing.

Various patents have been disclosed pertaining to closures and sealing systems for food packages, and they include U.S. Pat. Nos. 4,941,310; 5,009,828; 5,070,584; US 2003/0152296 A1; U.S. Pat. No. 6,692,147; B2; 2004/0114837 A1; 2004/0161178 A1; 2005/0196077 A1; 2005/0244083 A1; and, 2007/0110340 A1. However, as noted, supra, none of the above patents provide a solution to the problem of ice formation and air and moisture contamination following opening of a food package to access the contents therein. Also, these patents do not provide long term vacuum sealing at very low temperatures for square or cylindrical food containers.

BRIEF SUMMARY OF THE INVENTION

It is an object of the plastic re-sealable food package with an air removal port to provide an inexpensive, flexible, plastic package for vacuum storage of food which enables a user to easily access the contents therein and, to reseal and vacuum the package for continued, long term storage at extremely low temperatures.

It is another object of the plastic re-sealable food package to use a square shape of packages because this shape is the most space efficient in storing in a square box carton. There is no square re-sealable food package available on a market. Current re-sealable food package employs zipper strips, which allow only a linear locking engagement. Our elongate check valve facilitates closure of a food package of various shapes. In this patent application, we describe a square, cylindrical and flat bag shape food package.

A trough shape elongate check valve of previous applications is replaced with a simpler and more efficient elongate check valve.

Testing indicated that the air removal via a needle through the compressed foam sponge of previous application was found too slow. In the present application, it was replaced with the air removal port consisting of compressed foam sponge, a thin film and rigid housing. This compressed foam sponge valve blocks a large opening of the lid or side wall of the food package. A large diameter flat check valve allows much quicker air removal from the package.

One-way check valves are in common use to allow flow of gas or liquid through a tube or pipe in one direction while blocking in the opposite direction. These check valves are designed to fit a circular opening of a tube or pipe, but not for an elongate opening of square, cylindrical or linear food package. This plastic re-sealable food package relates to a new elongate check valve that fits into an elongate opening of a plastic film food package and for maintaining a vacuum within the package, hence enabling storing fresh or cooked foods at low temperature for a long time. The food package allows repeated opening and closing the check valve followed by restoring a vacuum to facilitate adding and/or removal of food without significant flavor or edibility loss.

It is another object of the plastic re-sealable food package to have a flexible but rigid rectangular, round or linear frame made of common polymer, e.g. high or low density polyethylene, polycarbonate or equivalent. For a square box type food package, the frame is encased by the top edge of a plastic film food package with a gusseted bottom. The film is made of thermo-plastics, e.g. polypropylene, polyethylene, etc., of about 2-3 mils in thickness. The free edge of the film is bonded to the side wall of the package, or lower edge of the frame, thus encasing the frame. A flexible but rigid lid is made of similar polymers, e.g. high or low density polyethylene, polycarbonate, nylon. The lid fits the frame snugly but this does not create air-tight closure. Thin polymer film is sandwiched between the frame and lid all way around the ridge of the square or round food container lid. When the air is removed from the interior of the package, the sandwiched film is sucked against rigid receptacle of the lid, inducing an air-tight sealing in a reproducible fashion.

A flat check valve with a compressed foam sponge and thin plastic film encased inside a rigid housing is installed on the lid opposing to a large round opening of the lid. A flat hollow spatula attachment of a vacuum pump can be inserted into the flat check valve housing between the compressed foam sponge and the lid. When the large opening of the lower wall of the spatula faces the large opening of the lid, vacuum pump is activated to aspirate air from the food package. When the air is removed, the vacuum around 90 kPa is generated interior of the film package which sucks the wrapping film of the package around the frame to the lid. The firmly sucked film against the lid shuts off the influx of air into the package. The lid can be opened easily by hands against the vacuum pressure of 90 kPa. After the food content is taken out/or added from/to the food package, the lid is placed back to the frame over the elongate check valve and air is removed, establishing vacuum inside the sealed package. The resealed vacuum package then can be stored in a freezer.

It is another object of the plastic re-sealable food package to have an air removal port with a film valve leaflet reinforced with compressed foam sponge. The port is installed on the lid against a large opening. A flat hollow spatula with a large opening on the bottom side is attached to a vacuum pump. This spatula can be inserted between the lid and the compressed foam sponge. When the opening of the bottom side of the spatula faces the opening of the lid, the air is removed by a vacuum pump, inducing vacuum in the interior of the package. When the spatula is pulled out of the air removal port, the film valve leaflet/compressed foam sponge is sucked against the opening of the lid, shutting the air influx into the package.

If a conventional rectangular or square rigid food container is preferred, the top edge of the container is used as the frame. Air vent is created on the upper portion of the food container. The film package is placed inside the container and its upper edge of the film package is bonded to the top edge of the food container. When vacuum is induced to the interior to the film food package, the food package collapses and the bottom is drawn toward the lid. After vacuum storage of foods is finished, the rigid food container can be converted to a conventional form by simply removing the film package and plugging the vent of the container.

For a bag-type food package, the film of the package wraps around a male polymer strip. When the male polymer strip is pushed into the female strip, the plastic film is sandwiched between them. When the air is vacuumed from the interior of the bag, the vacuum induces an air-tight fitting between the film and the female plastic strip.

The suction force generated by the vacuum, e.g. 90 kPa, is strong enough to shut off the air inflow into the interior of the food package but is weak enough to allow manual opening of the package. Opening of the elongate check valve enables access to the food package for removal and/or addition of food. After a desired portion of the food is taken out of the package, the lid is placed back on the rectangular, square or cylindrical frame or plastic strips of the bag and is closed so the vacuum can be reinstated by removing air from the interior of the package.

The bottom and or sidewall structure of the food package comprises a flexible, plastic film material such as low and high density polyethylene's, nylons, polyesters, possibly polyurethanes, and laminates thereof, with sufficient thickness to reduce significant migration of air through the film. Preferred materials of construction of the compressible foam are silicone foam rubbers and possibly polyurethane foams. Other rubber foams may be useful providing they have suitable characteristics similar to those of silicone and polyurethane foams without toxicity. These foam rubbers are listed in the Encyclopedia of Chemical Technology, by Kirk-Othmer, 3.sup.rd Edition, 1982 at: Vol. 11, page 78; Vol. 18, page 470; and, Vol. 20, pages 365-368 and 943; ISBN 0-471-02073-7; and incorporated herein by reference.

Periodic inspection of the film package during storage would be appropriate to determine if any migration of air through the plastic sidewalls of the package has occurred, causing a reduction in vacuum. This can be simply rectified by entering the package with the aspirating spatula, and in conjunction with the aspirating pump vacuuming out any air, and moisture. The presented re-sealable food storage package represents a significant improvement of frozen food storage that requires repeated open and closure for food retrieval, resealing the package, and restoring a vacuum. Aspiration will restore the vacuum and reseal the food package to enable storage at extremely low temperature, e.g. −60° C. with minimal ice formation on the stored food contents.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
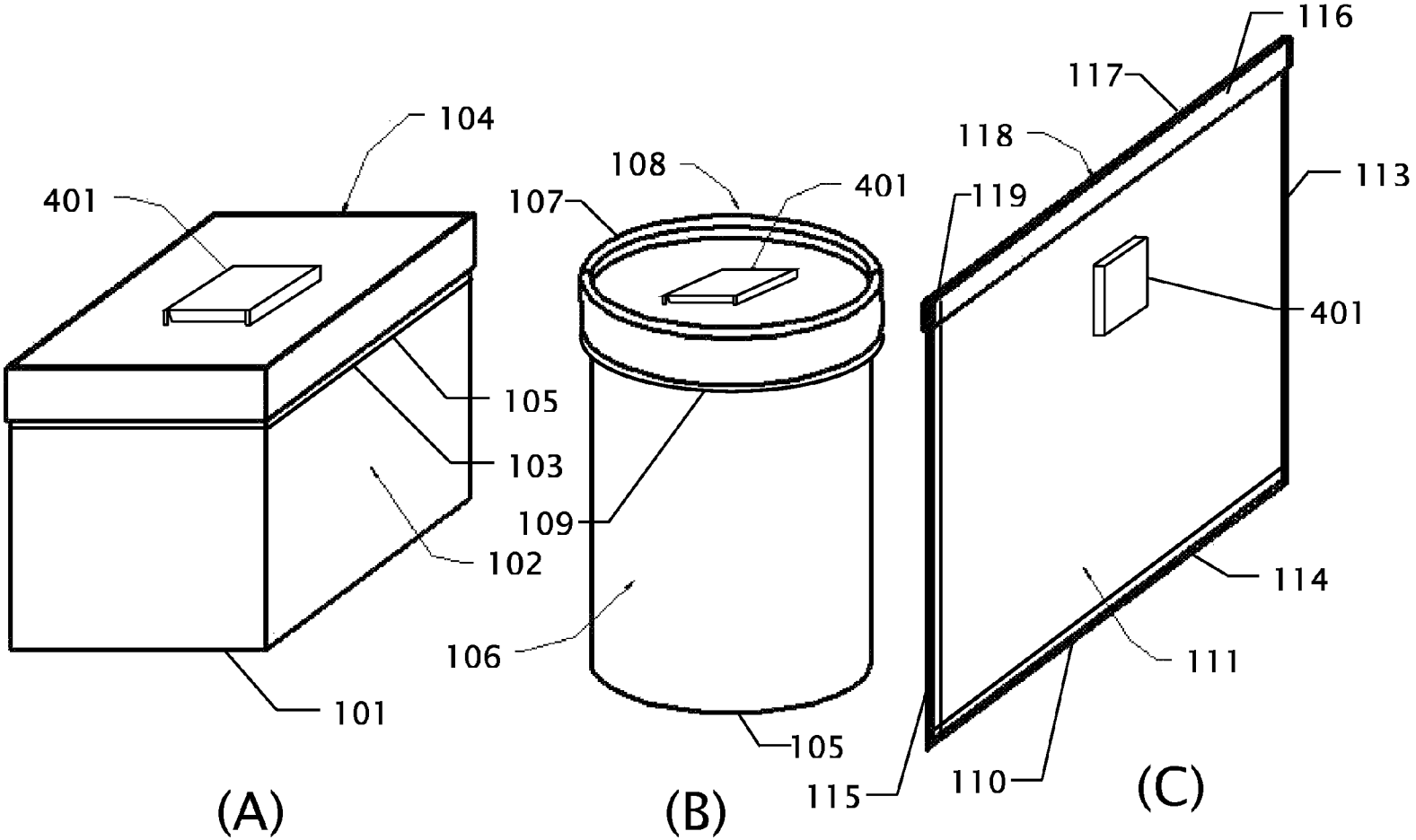
FIG. 1A is an isometric view of a square box type food package.
FIG. 1B is an isometric view of a cylindrical food package.
FIG. 1C is an isometric view of a flat bag type food package.

FIG. 1A shows an isometric view of a square shape collapsible plastic film food package 101. The top edge 103 of the collapsible film food package 102 is turned over the top ridge of the frame (105) and covered under the rigid but flexible lid 104. An air removal port 401 is installed on the lid.

FIG. 1B shows a cylindrical food package 105. The top edge 109 of a cylindrical film package 106 is turned over the top edge of a rigid but flexible ring (107). A flexible but rigid lid 108 is pushed against the ring frame (107) to close the container. The air removal port 401 is installed on the lid.

FIG. 1C illustrates a bag-type food package 110. Three sides 113, 114 and 115 of two film walls 111 & (112) are sealed. The top portions of the film walls 118 & 119 are sandwiched between two plastic strips 116 & (117). An air removal port 401 is bonded to the one side of wall of the bag 111.

Figure 2:
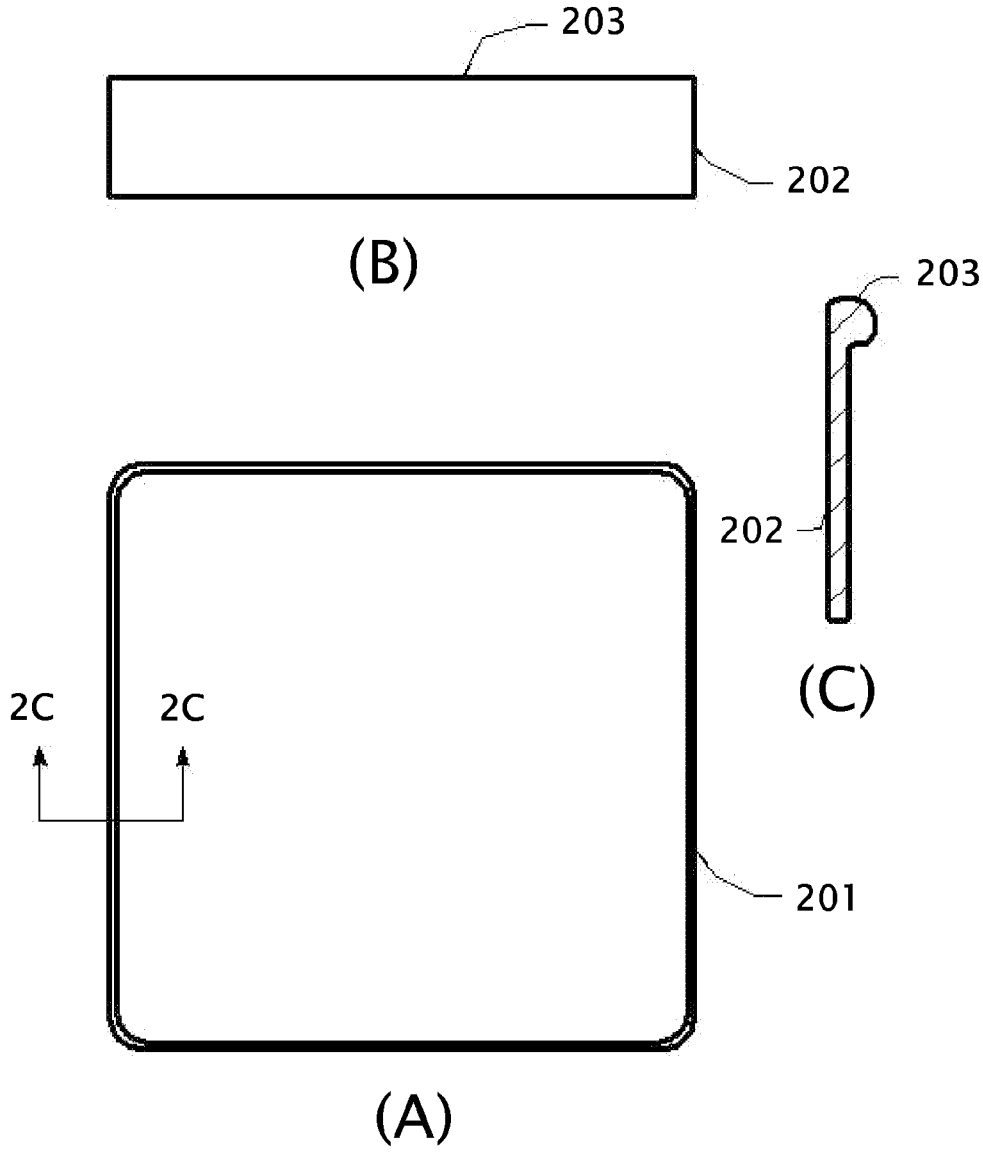
FIG. 2A is perspective view of a package frame of square shape.
FIG. 2B is a side view of the package frame of square shape.
FIG. 2C is a cross-sectional view of the package frame along the line 2C-2C of FIG. 2A.

FIG. 2A shows a perspective view of the rigid but flexible frame 201 of the square shape collapsible film package. FIG. 2B shows a side view of the frame 202. Its top portion is made round inwards (not visible). FIG. 2C shows an enlarged cross-sectional view of the frame 201, along the line 2C-2C of FIG. 2A. Its top portion 203 is rounded inwards.

Figure 3:
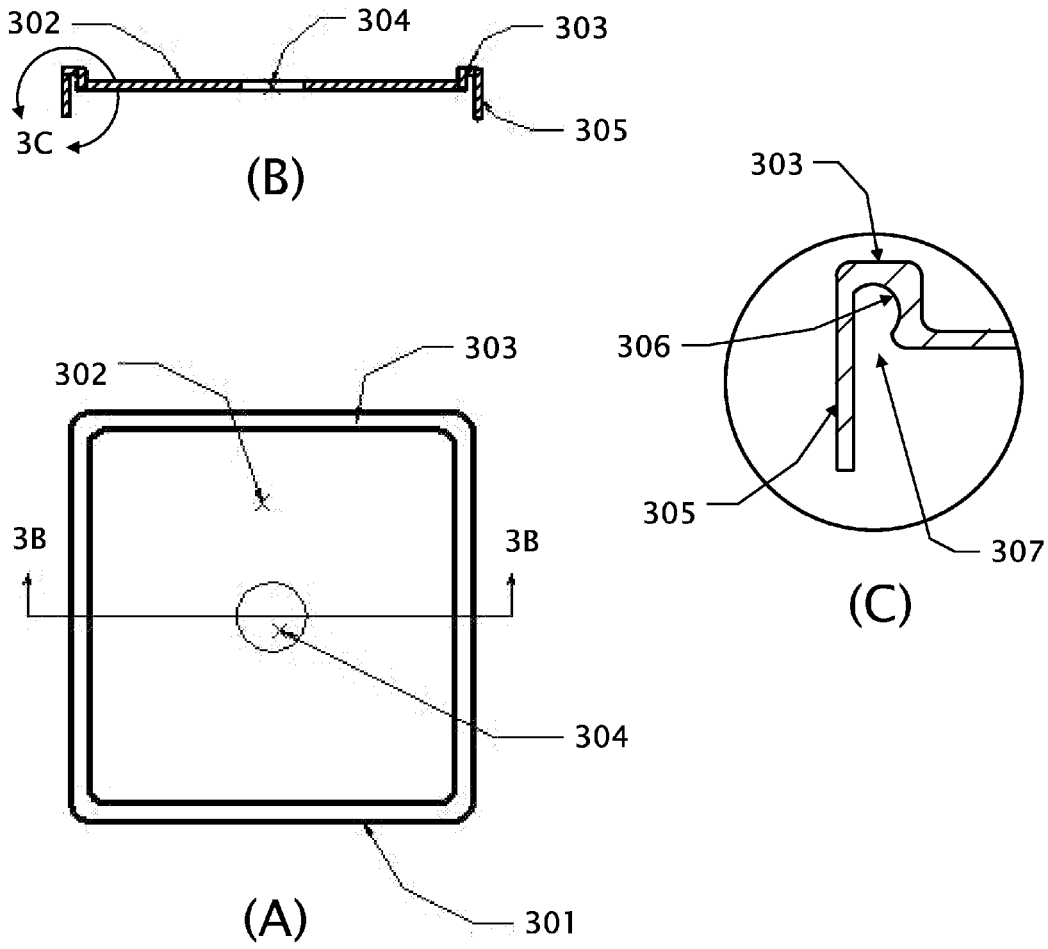
FIG. 3A is a perspective view of a lid.
FIG. 3B is a cross-sectional view of the lid through the line 3B-3B of FIG. 3A.
FIG. 3C is an enlarged cross-sectional view of the peripheral rim of the lid from detail line 3C in FIG. 3B.

FIG. 3A shows a perspective view of the lid 301 of the square food package. Its peripheral rim 303 is made round, matching the top rim of the frame 203. A large opening 304 is made on the central part of the lid 302.

FIG. 3B shows a cross-sectional view of the lid along the line 3B-3B of FIG. 3A. The central portion of the lid 302 has a large opening 304. Its periphery forms a round recess 303-305 all the way around its periphery that fits the top rim of the frame 203 of FIG. 2C.

FIG. 3C shows an enlarged cross-sectional view of the rim of the lid 3C-3C of FIG. 3B. A round recess 307 is formed between the outer rim 305 and the inner rim 306 of the lid 303.

Figure 4:
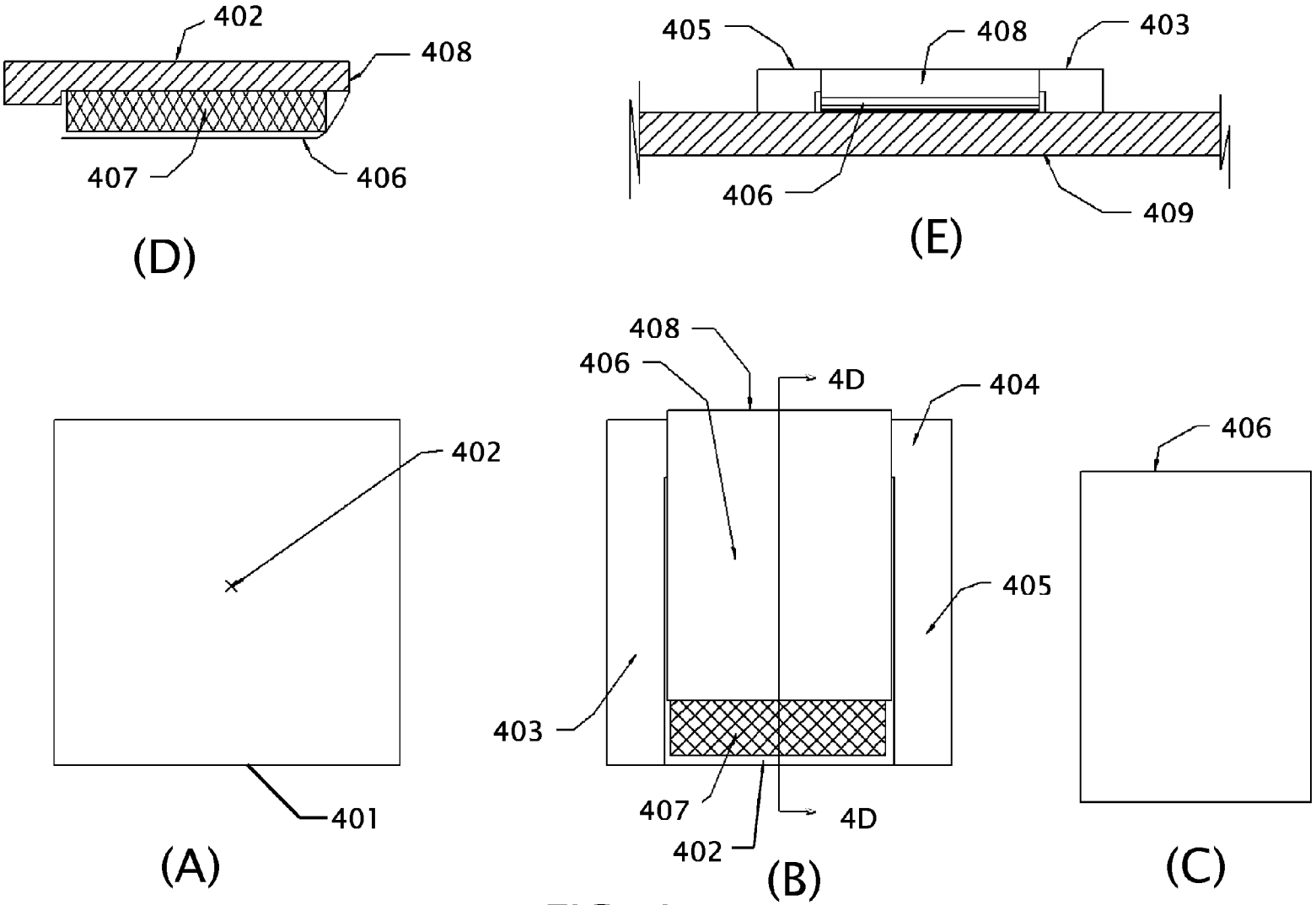
FIG. 4A is a perspective view of the top of a flat air removal port.
FIG. 4B is a perspective view of the underneath the air removal port.
FIG. 4C is a perspective view of a thin film valve leaflet.
FIG. 4D is a cross-sectional view of the air removal port along the line 4D-4D in FIG. 4B.
FIG. 4E is a frontal view of the air removal port.

FIG. 4A is a perspective view of the flat film check valve 401. Its housing 402 is made of rigid plastic, such as polycarbonate or high density polyethylene. FIG. 4B shows the undersurface of the flat check valve. Three sides 403-405 are elevated slightly. A foam sponge 407 is placed between the housing 402 and a film valve leaflet 406. The valve leaflet is bonded to the front surface of the housing 408. FIG. 4C shows a valve leaflet 407 made of a thin plastic film such as polypropylene or polyethylene.

FIG. 4D shows a cross-sectional view of the valve along the line 4D-4D before it is installed on the lid. A rectangular foam sponge 407 is placed between the valve housing 402 and the film valve leaflet 406. The valve leaflet is bonded to the front surface of the valve housing 408.

FIG. 4E shows a frontal view of the flat valve installed on the lid 409. The foam sponge block (not visible in this view) is compressed between the valve housing and the lid 409. The valve leaflet 406 runs between the lid 409 and the compressed foam sponge block.

Figure 5:
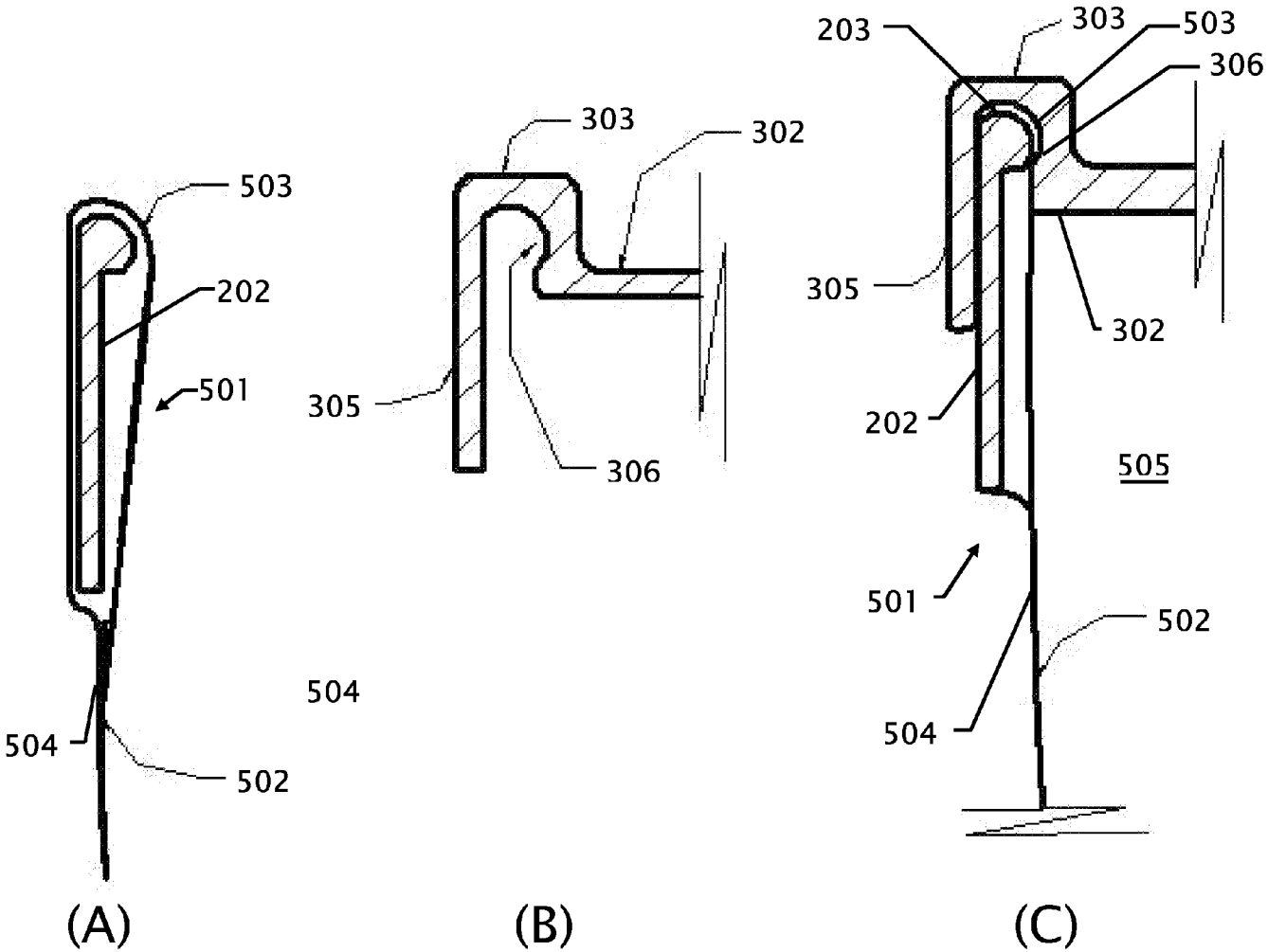
FIG. 5A is a cross-sectional view of the package wrapping the frame.
FIG. 5B is a cross-sectional view of the peripheral rim of the lid.
FIG. 5C is a cross-sectional view of the assembled lid-film covered frame.

FIG. 5A illustrates a cross-sectional view of the elongate film valve 501. The film 503 wraps around the frame 202. The top edge of the film 502 is bonded to the film below the frame 504. FIG. 5B shows a cross-sectional view of the periphery of the lid 302. It forms a round groove 305, 303 & 306 along the periphery of the lid 202. FIG. 5C demonstrates how the elongate check valve 501 is engaged. The round recess 303, 305 & 306 of the lid 302 is pushed to the frame 202, sandwiching the film 503. After vacuum is applied to the interior of the food package 505, the thin film 503 is sucked against the inner rim of the lid 306, shutting the influx of air into the interior of the package.

Figure 6:
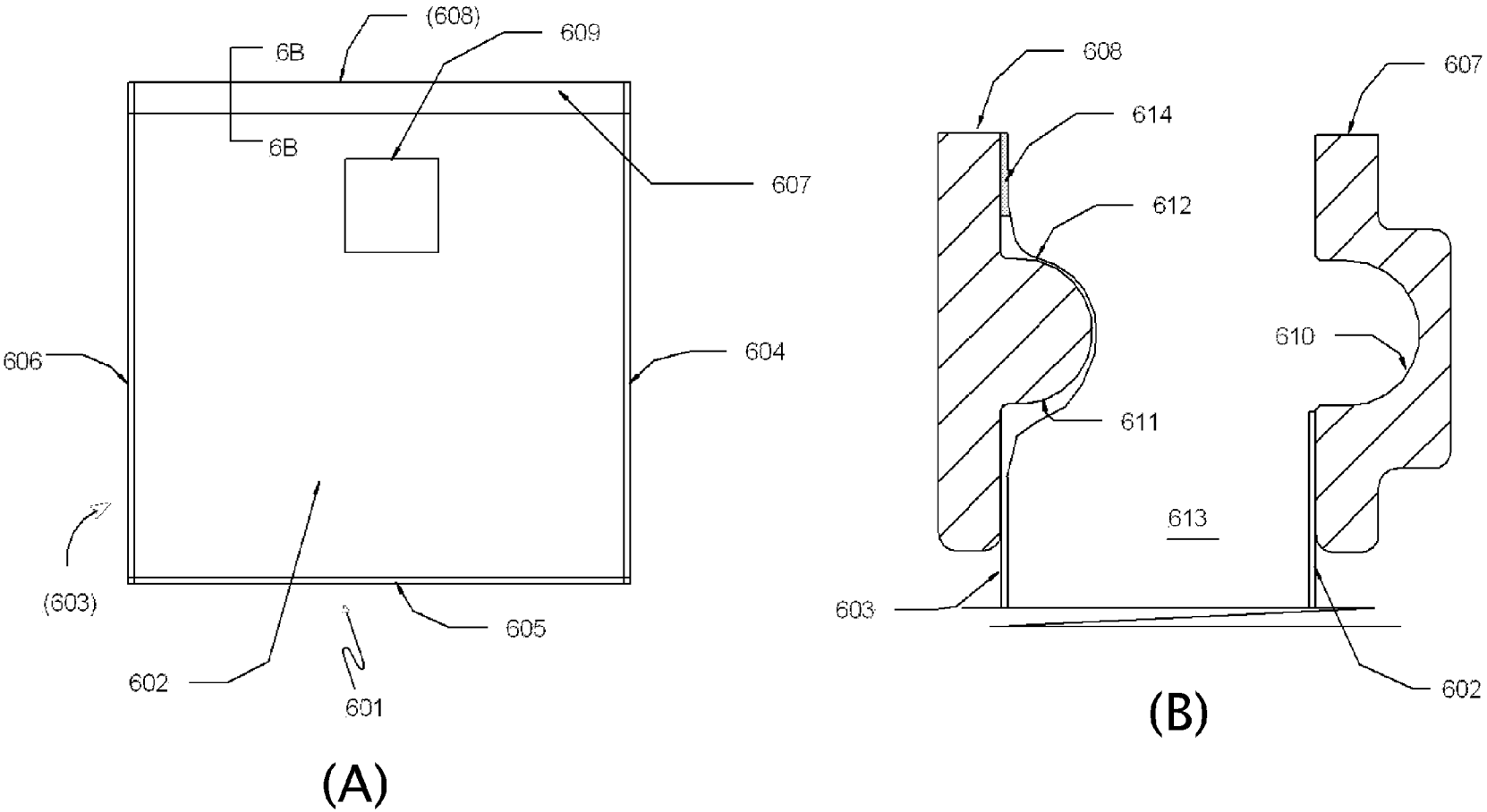
FIG. 6A shows a perspective view of a flat bag type food package.
FIG. 6B is an enlarged cross-sectional view along the 6B-6B of FIG. 6A before the strips are engaged.

FIG. 6A shows a perspective view of a flat package 601. Three sides of two thin films 602 & (603) are bonded on three sides, 604, 605 & 606. Female 607 and male (608) strips are made of flexible but rigid plastics, such as low or high density polyethylene. The front plastic film wall 602 is boded to the low inner edge of the female plastic strip 607, whereas the top edge of the back film wall (608) is bonded to the top inner edge of the male plastic strip (608). A flat film check valve 609 is bonded to the front film wall 602 of the film package.

FIG. 6B illustrates a cross-sectional view of the plastic strips 607 & 608 before they are engaged. Anterior film wall 602 is bonded to the low inner side of the female strip. Posterior film wall 603 is bonded to the top inner edge 614 of the male strip 608. When the male protrusion 611 is pushed into the female groove 610, the bag is closed. This closure is, however, not air-tight. When vacuum pressure is generated in the interior of the package 613, the top portion of the film wall 612 is sucked against the female round groove 610, shutting the air influx into the interior of the package.

The present elongate film check valve is applicable to many configurations as shown in FIGS. 1A, 1B&1C. If collapsible resealable food package is desired to be installed inside a solid square or cylindrical container, the frame is replaced with a rigid main container. A venting hole is created near the top portion of the main body of the container, which allows the upward rise of the collapsible food package inside the rigid container. If the container is to be used in a conventional fashion after the vacuum sealing is over, the collapsible film package is removed from the rigid container, and the air vent is plugged. The container is now can be used in the conventional fashion.

Figure 7:
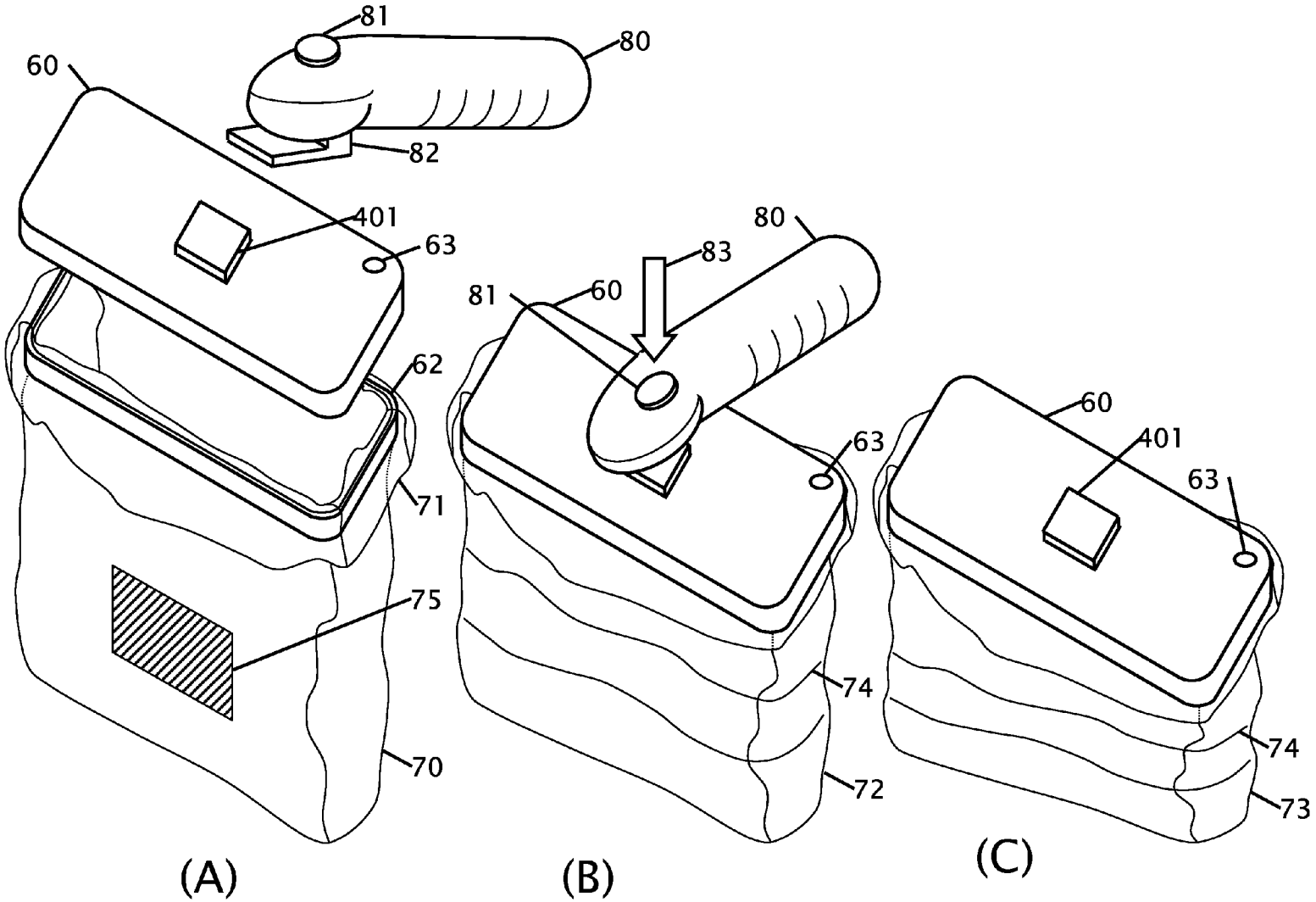
FIG. 7A shows a perspective view of a vacuum bag with a rigid top housing in an open configuration.
FIG. 7B shows a perspective view of a vacuum bag from FIG. 7A as it is being vacuumed.
FIG. 7C shows a perspective view of a vacuum bag from FIG. 7A in a vacuumed condition.

FIG. 7A shows a perspective view of a vacuum bag with a rigid top housing in an open configuration, FIG. 7B shows a perspective view of a vacuum bag from FIG. 7A as it is being vacuumed and FIG. 73C shows a perspective view of a vacuum bag from FIG. 7A in a vacuumed condition. From these figures the expandable bag 70 is shown on or placed over the compression rim 62 such that the free end 71 is draped over the compression rim 62. A labeling area 75 is shown on the front of the bag 70 in FIG. 7A. This labeling area 75 can be used to write information regarding the contents of the bag or when the bag was stored to indicate and expiration date of the contents. The rigid end housing lid 60 is shown with the air removal port 401 extending from the lid 60 with the air removal port 401. The lid also shows an optional burp or vent port 63 that can be operable as a burp valve to quickly exhaust air out of the expandable bag 70 by squeezing the bag 70 or as a vent valve to make the lid 60 easier to remove by providing a vacuum release.

From FIG. 7A the bag 70 is shown in a filled condition. The aspiration spatula 82 of the vacuum device 80 is brought onto the air removal port 401 and the activation button 81 is depressed 83 to begin removal of the air. In FIG. 7B the bag 72 is partially vacuumed and the pleats 74 or bellows of the bag 72 begin to show as the bag 72 is reduced in size. From FIG. 7C, sufficient air has been removed from bag 73 and the bag can be placed into storage.

Thus, specific embodiments of a plastic re-sealable food package have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A food package providing a plastic film food container comprising:

a bag having flexible sides with an openable end;

said openable end is securely placed between a rigid end housing having a periphery edge;

a rigid compression rim that engages into said periphery edge of said rigid end housing to seal said openable end of said bag there between;

said rigid end housing further having an air removal port; said air removal port having a foam sponge element bonded or integrated to said air removal port; a rigid valve housing surrounding said air removal port; an aspiration spatula; a bore defined within said foam sponge element for insertion of said aspiration spatula, whereupon insertion of said aspiration spatula into said air removal port over said bore, compresses said foam sponge element to form a vacuum seal with said foam sponge element thereby enabling repeated aspiration of air and moisture from said food package to maintain a vacuum therein said bag, and said aspiration spatula further includes a vacuum pump that is temporarily installable on said air removal port to vacuum said bag whereby reducing an internal air volume of said bag enabling long term use of food in said bag at low temperatures and vacuum pressures.

2. The food package according to claim 1 wherein said air removal port provides a sufficient closing force to maintain a vacuum of at least about −90 kPa, at a low temperature about −20 C. to about −60 C.

3. The food package according to claim 1 wherein said air removal port can be repeatedly operable with said vacuum pump to maintain a seal of about −90 kPa.

4. The food package according to claim 1 wherein said air removal port is selected from the group consisting of silicone rubbers, thermoplastic rubbers, synthetic rubbers, and polyurethanes.

5. The food package according to claim 1 wherein said bag is selected from the group consisting of low and high density polyethylene, nylon, polyester, polyurethane, or laminate.

6. The food package according to claim 1 wherein said bag is essentially transparent or translucent thereby providing visual inspection and tactile monitoring of a vacuum in the package, and upon loss of said vacuum, insertion of said vacuum pump into said valve enables removal of air and moisture.

7. The food package according to claim 1 wherein said bag further includes a marking area.

* * * * *